US010345838B1

(12) United States Patent
Karadi et al.

(10) Patent No.: US 10,345,838 B1
(45) Date of Patent: Jul. 9, 2019

(54) VOLTAGE REGULATION CIRCUITS WITH SEPARATELY ACTIVATED CONTROL LOOPS

(71) Applicant: NXP B.V., Eindhoven (NL)

(72) Inventors: Ravichandra Karadi, Eindhoven (NL); Arnoud Pieter van der Wel, Vught (NL)

(73) Assignee: NXP B.V., Eindhoven (NL)

( * ) Notice: Subject to any disclaimer, the term of this patent is extended or adjusted under 35 U.S.C. 154(b) by 0 days.

(21) Appl. No.: 16/019,129

(22) Filed: Jun. 26, 2018

(51) Int. Cl.
*G05F 1/575* (2006.01)
*G05F 1/573* (2006.01)

(52) U.S. Cl.
CPC ..... *G05F 1/575* (2013.01); *G05F 1/573* (2013.01)

(58) Field of Classification Search
CPC . G05F 1/59; G05F 1/595; G05F 1/563; G05F 1/56; G05F 1/575; G05F 1/465; G05F 1/468; G05F 1/462; G05F 1/562; G05F 1/565; G05F 1/567; G05F 1/569; G05F 1/571; G05F 1/573; G05F 1/5735
USPC ..... 323/269–270, 273–281
See application file for complete search history.

(56) References Cited

U.S. PATENT DOCUMENTS

| | | | | |
|---|---|---|---|---|
| 6,246,555 | B1 * | 6/2001 | Tham | G05F 1/575 323/274 |
| 6,952,091 | B2 | 10/2005 | Bansal | |
| 7,015,680 | B2 | 3/2006 | Moraveji et al. | |
| 2013/0113447 | A1 * | 5/2013 | Kadanka | G05F 1/56 323/280 |

* cited by examiner

*Primary Examiner* — Nguyen Tran

(57) ABSTRACT

An example embodiment is directed to a voltage regulation circuit. The voltage regulation circuit comprises a first control loop and a second control loop that are separately activatable. The first control loop regulates an output current provided to an output terminal, and the second control loop regulates an output voltage provided to the output terminal. The voltage regulation circuit further includes a mode switching circuit that switches operation between the first and the second control loops by separately activating one of the first and second control loops and deactivating the other in response to a fault condition at the output terminal at which a regulated load is connectable.

20 Claims, 5 Drawing Sheets

VOLTAGE REGULATION CIRCUITS WITH SEPARATELY ACTIVATED CONTROL LOOPS

OVERVIEW

Aspects of various embodiments are directed to a voltage regulation circuit that provides separately activatable control loops.

Linear Voltage Regulator circuits are used to maintain a steady voltage. For example, the resistance of the regulator output pass devices is varied in accordance with the load current, resulting in a constant voltage output. Many linear voltage regulation circuits are equipped with over-current protection (OCP) to handle over-current fault events. Often, a part of the operating envelope occurs where both the voltage regulation loop and the OCP are active at the same time.

These and other matters have presented challenges to voltage regulation circuits implementations, for a variety of applications.

SUMMARY

Various example embodiments are directed to issues such as those addressed above and/or others which may become apparent from the following disclosure concerning voltage regulation circuits that separately activate control loops at a given time based on feedback indicative of a relative output current and/or voltage at the output terminal.

In certain example embodiments, aspects of the present disclosure involve a voltage regulation circuit having a mode switching circuit which responds to feedback indicative of a function of a relative output current and output voltage, as provided to a regulated load, by selectively activating a first control loop or a second control loop to regulate the output current or output voltage.

In a more specific example embodiment, a voltage regulation circuit includes a first control loop and a second control loop (each including and/or characterized by circuitry) that are separately activatable. The first control loop regulates an output current provided to an output terminal and the second control loop regulates an output voltage provided to the output terminal. A mode switching circuit switches operation between the first and second control loops by separately activating one of the first and second control loops and deactivating the other in response to a fault condition at the output terminal at which a regulated load is connectable. In various embodiments, the mode switching circuit can switch between the first and the second control loops with a finite (e.g., small) non-zero hysteresis, such that only one of the first and the second control loops is active at the same time. In some more-specific embodiments, the voltage regulation circuit can further include various additional circuitry as further described herein.

In another specific example embodiment, a voltage regulation circuit includes a first feedback circuit that provides the first control loop and a second feedback circuit that provides the second control loop which are both separately activatable. As described above, the first feedback circuit regulates a current at the output terminal via the first control loop and the second feedback circuit regulates a voltage at the output terminal via the second control loop. The voltage regulation circuit further includes a comparator circuit and a mode switching circuit. The comparator circuit provides an output responsive to a relative voltage at an output terminal at which a regulated load is connectable. As previously described, the relative voltage can be indicative of a scaled version of current at the output terminal and of there being or not being a fault condition (e.g., an over current fault condition). The comparator circuit can provide the output to the mode switching circuit, which causes the mode switching circuit to switch between the first and second control loops. For example, the mode switching circuit switches operation between the first and second control loops by separate activation in response to a fault condition at the output terminal and the output provided by the comparator circuit.

The mode switching circuit, in accordance with a number of embodiments, can include at least one switch circuit and a (second) comparator circuit. The comparator circuit of the mode switching circuit provides an output signal to the at least one switch circuit based on a comparison of a voltage at the output terminal and the output provided by the (current) comparator circuit. The output provided by the (current) comparator circuit is based on a comparison of the relative voltage at the output terminal (e.g., the scaled version of the current) to a current limit. The at least one switch circuit responds to the output signal from the (second) comparator circuit by selectively activating one of the first and second control loops at a time.

In various specific embodiments, the mode switching circuit can switch between the first and second control loops such that (only) one of the first and second control loops is active at a particular time. However, embodiments are not so limited, and in some embodiments, one of the loops can be, dominant over the other. For example, the voltage regulation circuit can operate in a first mode responsive to the fault condition being an over current fault condition. The voltage regulation circuit can operate in a second mode responsive to the fault condition being an over (or under) voltage fault condition. During the first mode, the first control loop is active and is dominant over the second control loop. In specific embodiments, during the first mode, the second control loop is in active.

In a number of more-specific embodiments, the voltage regulation circuit include common control circuitry that is arranged as part of both the first and second control loops. The common control circuit includes an error amplifier and a pass device that include at least one pass transistor. The error amplifier provides an error signal based on a comparison of a reference voltage and a voltage that is a function of the output voltage at the output terminal. The voltage is, for example, the output provided by the (current) comparator circuit or a feedback signal from the second control loop. The pass device responds to the error signal from the error amplifier by adjusting a current provided to the output terminal and reducing the error signal. For example, the pass device can selectively pass current to the output terminal based on the error signal which is connected to inputs of one or more transistors of the pass device.

In a number of embodiments, the above described voltage regulator circuits can operate in a soft-start mode. For example, the mode switching circuit can activate the first control loop (e.g., the current control loop) in response to a startup of the voltage regulation circuit. The mode switching circuit can then activate the second control loop (e.g., the voltage control loop) in response to the output voltage at the output terminal reaching a set-point. The above-described voltage regulation circuit thereby beneficially implements a soft-start mode without additional effort or complexity.

Various embodiments are directed to methods of providing voltage regulation and over-current protection (OCP) using separately activatable control loops. An example method includes regulating an output current provided to an output terminal at which a regulated load is connectable to or is connected by activating a first control loop and regulating an output voltage provided to the output terminal by activating a second control loop. The method can include switching operation between the first and second control loops by separate activation in response to a fault condition at the output terminal. In various specific embodiments, the method further includes providing an output responsive to a relative voltage at the output terminal, the relative voltage being indicative of a scaled version of current at the output terminal. The output can be provided by a (current) comparator circuit and indicates whether or not an over current fault condition is occurring. The switch between the control loops, such as by a mode switching circuit, can be in response to the output provided by the current comparator circuit. As described above, the method can further include the voltage regulation circuit operating in a first mode responsive to the fault condition being an over current fault condition and in a second mode responsive to the fault condition being an over (or under) voltage fault condition. In various embodiments, during the first mode, the first control loop is active and the second control loop is inactive and, during the second mode, the second control loop is active and the first control loop is inactive. However, embodiments are not so limited, and one loop can be dominant over the other in respective modes.

The above discussion/summary is not intended to describe each embodiment or every implementation of the present disclosure. The figures and detailed description that follow also exemplify various embodiments.

BRIEF DESCRIPTION OF FIGURES

Various example embodiments may be more completely understood in consideration of the following detailed description in connection with the accompanying drawings, in which.

Figure 1:
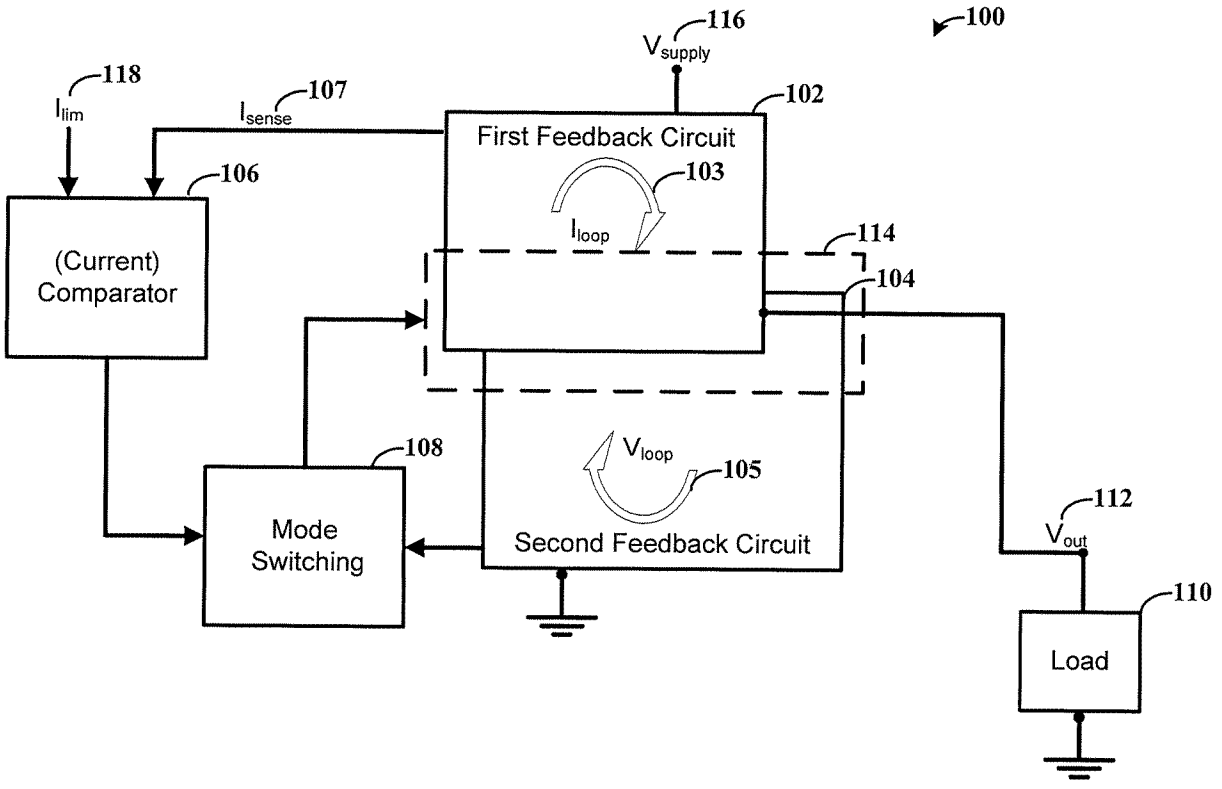
FIG. 1 illustrates an example of a voltage regulation circuit shown as a block diagram, in accordance with the present disclosure.

While various embodiments discussed herein are amenable to modifications and alternative forms, aspects thereof have been shown by way of example in the drawings and will be described in detail. It should be understood, however, that the intention is not to limit the disclosure to the particular embodiments described. On the contrary, the intention is to cover all modifications, equivalents, and alternatives falling within the scope of the disclosure including aspects defined in the claims. In addition, the term "example" as used throughout this application is only by way of illustration, and not limitation.

DETAILED DESCRIPTION

Aspects of the present disclosure are believed to be applicable to a variety of different types of apparatuses, systems and methods involving voltage regulation circuits that provide separately activatable control loops. In certain implementations, aspects of the present disclosure have been shown to be beneficial when used in the context of a voltage regulation circuit that uses a mode switching circuit to separately activate first and second control loops for regulating an output voltage and output current. In some embodiments, the mode switching circuit responds to feedback indicative of a fault condition by activating a first control loop that regulates the output current and not activating the second control loop which regulates the output voltage. While not necessarily so limited, various aspects may be appreciated through the following discussion of non-limiting examples which use exemplary contexts.

Accordingly, in the following description various specific details are set forth to describe specific examples presented herein. It should be apparent to one skilled in the art, however, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element. Also, although aspects and features may in some cases be described in individual figures, it will be appreciated that features from one figure or embodiment can be combined with features of another figure or embodiment even though the combination is not explicitly shown or explicitly described as a combination.

Specific embodiments are directed to circuitry that provides voltage regulation as well as over-current protection (OCP). As a specific example, many linear regulations, such as low-drop out voltage regulators (LDOs), provide voltage regulation as well as OCP to a connected load. An LDO can have a main regulation loop that provides voltage regulation and an auxiliary OCP loop that provides OCP, with both loops being active at particular times. A smooth handover between the voltage regulation and the OCP can be beneficial to mitigate or prevent interference in operation between the two loops. However, as noted above, often, a part of the operating envelope occurs where both loops are active at the same time. As such, the loop compensation design can be difficult, particularly in the region where both loops are simultaneously active. As a specific example, an OCP loop can cause or attempt to cause current provided through a pass device to the output load to be reduced while the voltage regulation loop is causing or attempting to cause the current provided through the pass device to be increased. In accordance with various embodiments, the voltage regulation circuit includes a first feedback circuit that provides a first control loop, such as an OCP loop, and a second feedback circuit that provides a second control loop, such as voltage regulation loop which are separately activatable by a mode switching circuit. As the control loops are separately activated, the voltage regulation circuit can prevent or mitigate the operations of the loops from interfering with one another and can be compensated independently. Separately activating the control loops, as used herein, includes or refers to activation of one control loop while deactivating the other control loop. The activation and deactivation of respective control loops can be simultaneous, in various embodiments, and/or can be at different times (e.g., one loop is dominant over the other and/or the activation or deactivation occurs at a delayed time from one another).

In various specific embodiments, the first control loop provides OCP and keeps the voltage regulation circuit in a constant current mode. The second control loop can provide regulation voltage and keeps the voltage regulation circuit in a constant voltage mode. The transition between the two modes can occur by the mode switching circuit comparing a feedback signal with a scaled version (e.g., a replica that is a scaled version or otherwise indicative of a scaled version) of the output current. The compensation provided by the two loops can be performed sequentially and, in some instances, not simultaneously. For example, the voltage regulation circuit can activate the second control loop (e.g., voltage regulation) to meet the transient response requirements and while the first control loop (e.g., OCP) is inactive (e.g., open). The voltage regulation circuit can then activate the first control loop, and deactivate the second control loop such that the two loops are not active at the same time. However, as further described herein, various embodiments are not so limited. For example, the voltage regulation circuit can operate in a first mode in which the first control loop is dominant over the second control loop.

In various specific embodiments, the voltage regulation circuit can provide a natural soft-start. For example, upon start-up, the voltage regulation circuit can be in the constant current mode. In the constant current mode, the first control loop (e.g., OCP) can be active or otherwise dominant. The voltage regulation circuit can then transition into the constant voltage mode in which the second control loop (e.g., voltage regulation) is active and the first control loop is inactive. The transition after the output voltage rises to its set-point. Additionally, the soft-start can occur without control of the feedback signal or reference signal. For example, the constant current mode can be maintained during start-up irrespective of the load capacitor or load resistance.

Turning now to the figures, FIG. 1 illustrates an example of a voltage regulation circuit, in accordance with the present disclosure. In various specific embodiments, the voltage regulation circuit 100 provides voltage regulation and current regulation (for a fault condition) to a regulated load 110 that is connected to the voltage regulation circuit 100. The voltage regulation circuit 100 can include a linear voltage regulation circuit, although embodiments are not so limited. The voltage regulation circuit 100 provides a regulated voltage to an output terminal 112 connectable to the regulated load 110 via a supply voltage $V_{sup}$ 116.

As illustrated, the voltage regulation circuit 100 includes a first control loop 103 and a second control loop 105 which are separately activatable. In the embodiment illustrated by FIG. 1, the first control loop 103 is provided by a first feedback circuit 102 and the second control loop 105 is provided by a second feedback circuit 104. More specifically, the first control loop 103 is a current control loop, which is also sometimes interchangeably referred to as OCP loop. The second control loop 105 is a voltage regulation loop, which is sometimes interchangeably referred to as the main regulation loop. The first feedback circuit 102 compensates or regulates current at the output terminal 112 via the current control loop. The second feedback circuit 104 compensates or regulate voltages at the output terminal 112 via the voltage regulation loop.

The voltage regulation circuit 100 can selectively activate the first and second control loops 103, 105 to transition between different modes of operation using a mode switching circuit 108. The mode switching circuit 108, as further described herein, can switch operation between the first and second control loops 103, 105 by separate activation in response to a fault condition at the output terminal 112 and an output provided by the comparator circuit 106. For example, the mode switching circuit 108 activates the control loops 103, 105 by comparing a feedback signal from the second control loop 105 to a replica or scaled version of the output current as provided at the output terminal 112. A comparator circuit 106, which is herein referred to as a current comparator circuit for ease of reference, provides the replica or scaled version of the output current. For example, the current comparator circuit 106 provides an output responsive to a relative voltage at the output terminal 112 at which a regulated load, such as the illustrated load 110, is connectable. The relative voltage is indicative of or otherwise is a function of the current output at the output terminal 112, and can indicate whether or not a fault condition is occurring. The current comparator circuit 106 can provide the output to the mode switching circuit 108 and the mode switching circuit 108 uses the output to switch between the first and second control loops 103, 105. For example, the relative voltage can be indicative of or otherwise include a replica or scale version of the output current, e.g., $I_{sense}$ 107 (which is sometimes herein referred to as $I_{sen}$), which is mirrored and/or input to the current comparator circuit 106. The current comparator circuit 106 compares $I_{sense}$ 107 to a current limit, e.g., $I_{lim}$, 118, and provides an output indicative of a fault condition (e.g., over current) based on the comparison (or indicative of no fault condition).

The mode switching circuit 108 switches between the first and second control loops 103, 105 in response to the fault condition at the output terminal 112 and/or the output provided by the current comparator circuit 106. The mode switching circuit 108 can compare the output from the current comparator circuit 106 to a feedback signal from the second feedback circuit 104 to selectively activate the control loops 103, 105. In various embodiments, to prevent or mitigate interference between the control loops 103, 105, the mode switching circuit 108 can switch between the first and second control loops 103, 105 such that only one of the control loops 103, 105 is active at a particular (or any) time.

Figure 2:
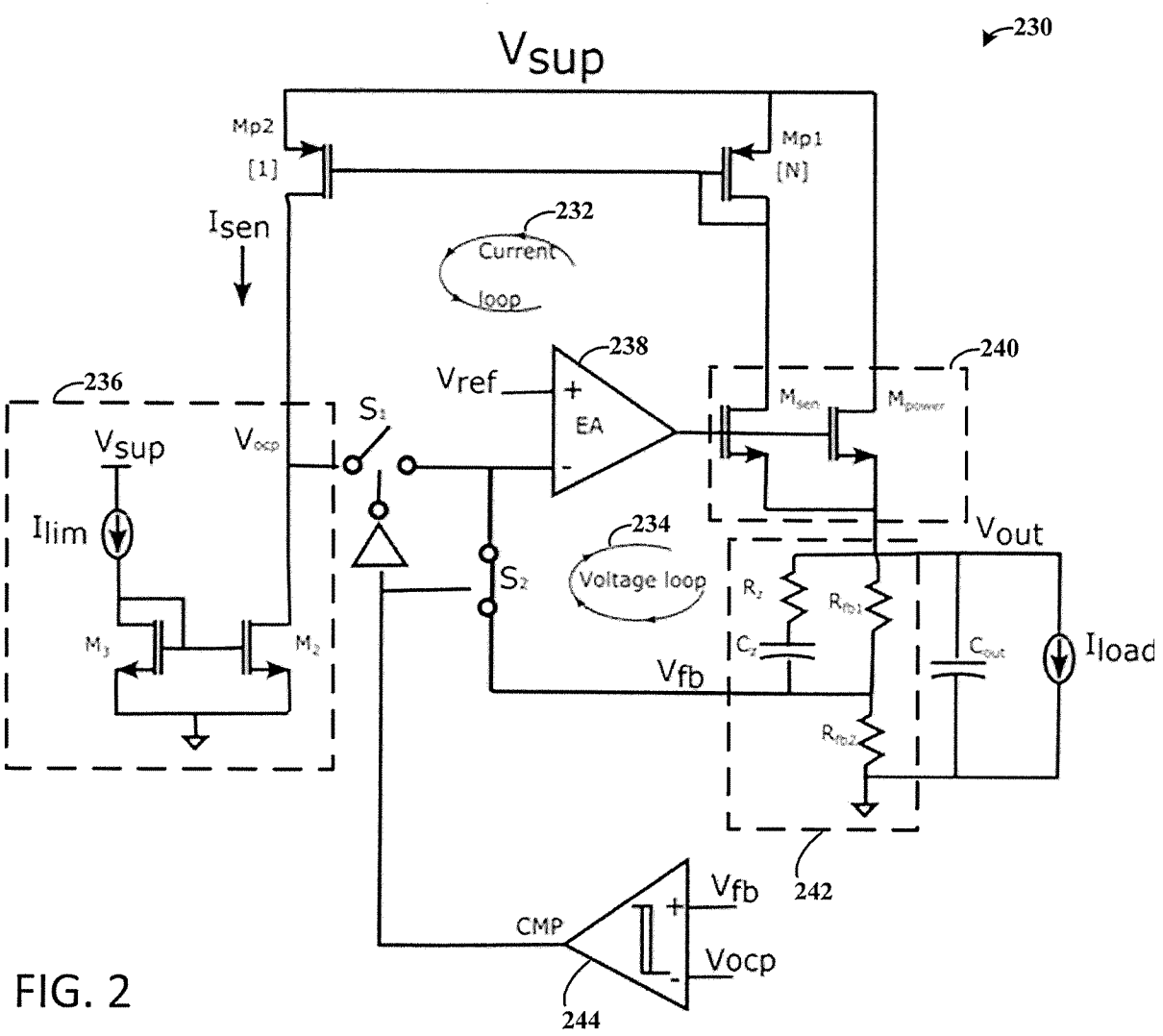
FIG. 2 illustrates another example representation of a voltage regulation circuit, in accordance with the present disclosure.

The mode switching circuit 108 can include at least one switch circuit and a second comparator circuit, which is herein referred to as a voltage comparator circuit for each of reference, and an example of which is further illustrated by FIG. 2 as discussed further herein. The voltage comparator circuit provides an output signal to the at least one switch in order to open or close the at least one switch and effectively activate the first or second control loops 103, 105. As noted above, the output signal is based on a comparison of the output from the current comparator circuit 106 to the feedback signal. For example, the voltage comparator circuit compares a voltage at the output terminal 112 (as provided as a feedback signal from the second control loop 105) to the output provided by the current comparator circuit 106. The at least one switching circuit responds to the output signal provided by the voltage comparator circuit by selectively activating one of the first and second control loops 103, 105. For example, the switching circuit selectively activates one of the first and second control loops 103, 105 and deactivates the other.

As may be appreciated, a relative current that is greater than the current limit indicates a (over-current) fault condition is occurring. In response to the fault condition, the first control loop 103 is activated to regulate the output current. More specifically, the voltage regulation circuit 100 can operate in a first mode in response to the fault condition. The first mode can include the previously described constant current mode. During the first mode, the mode switching circuit 108 activates the first control loop 103 to regulate the current output. In various specific embodiments, during the first mode, the first control loop 103 is dominant over the second control loop 105. In some embodiments, during the first mode, the second control loop 105 is inactive, although embodiments are not so limited.

As further illustrated by FIG. 1, the first and second feedback circuits 102, 104 can include common control circuitry 114 that is arranged as part of both the first and second control loops 103, 105. The common control circuitry 114 can include an error amplifier and a pass device. The error amplifier selectively compares the output of the current comparator circuit 106 or the feedback signal from the second feedback circuit 104 to a reference voltage responsive to the mode switching circuit 108. The error amplifier provides an error signal, as amplified, that is based on a comparison of the reference voltage to a voltage that is a function of the output voltage at the output terminal 112, e.g., the output provided by the current comparator circuit 106 or a feedback signal from the second control loop 105. The error amplifier is coupled to the pass device, which includes one or more transistors having inputs that are coupled to the output of the error amplifier. In some specific embodiments, the one or more transistors have gates coupled to the output of the error amplifier. The pass device responds to the error signal by adjusting a current passed through the pass device to the output terminal 112 and resulting in a reduction in the error signal.

As a specific example, such as further illustrated by FIG. 2, when the first control loop 103 is active, a fraction of the output current $I_{sense}$ 107 (e.g., the replica or scaled version of the output current) is greater than the current limit, $I_{lim}$ 118, and the mode switching circuit 108 activates the first control loop 103 by connecting the output of the current comparator circuit 106 to the error amplifier. The error amplifier compares the reference voltage to the output of the current comparator circuit 106 and outputs an error signal on the gate(s) of the pass device to reduce a current passed by the pass device to the output terminal 112. Once the fault condition is removed (e.g., the current sinks below $I_{lim}$ 118) and/or in response to a voltage being outside a threshold, the second control loop 105 can be activated and the first control loop 103 is deactivated (e.g., is inactive). For example, in response to the feedback signal exceeding the output from the current comparator circuit 106, the mode switching circuit 108 activates the second control loop 105 by connecting the feedback signal to the error amplifier, and, optionally, disconnecting the output of the current comparator circuit 106 from the error amplifier. The error amplifier compares the reference voltage to the feedback signal and outputs the error signal to input(s) of the pass device (such as on the gate(s) of the pass device) to adjust (increase or decrease) the current passed through the pass device and thereby adjust (increase or decrease) the output voltage at the output terminal 112, which can be provided to a connected load 110.

In various specific embodiments, the mode switching circuit 108 can activate the first control loop 103 at a startup of the voltage regulation circuit 100 which can be used to provide a soft start-up. The soft-start can occur without control of the feedback signal or reference signal. For example, the first control loop 103 can be active during start-up irrespective of the load capacitor or load resistance. The mode switching circuit 108 can activate the second control loop 105 (as well as deactivating the first control loop 103) in response to the output voltage at the output terminal 112 reaching a set-point.

FIG. 2 illustrates another example of a voltage regulation circuit, in accordance with various embodiments. In some embodiments, FIG. 2 illustrates a more-detailed version of the circuit illustrated by FIG. 1, however, embodiments are not so limited.

As illustrated, the voltage regulation circuit 230 includes a first control loop 232 and a second control loop 234, which include common control circuitry shared between the control loops 232, 234. The common control circuitry includes the error amplifier 238 and the pass device 240. The first control loop 232 includes various sense transistors, the error amplifier 238, and the reference current source $I_{lim}$. For example, the first control loop includes a transistor of the pass device 240 (e.g., $M_{sen}$), and sense transistors Mp1 and Mp2. The transistor $M_{sen}$ of the pass device 240 can provide the replica or scaled version of the output current, which may include a scale of 1/100, 1/1000, among other values. The second control loop 234 includes the error amplifier 238, the pass device 240, feedback resister divider circuitry 242, and output capacitor $C_{out}$. The pass device 240, as illustrated, can include one or more transistors, such as the transistors $M_{sen}$ and $M_{power}$. Although the various transistors are illustrated as n-channel metal-oxide-semiconductor field-effect (nMOS) transistors, embodiments are not so limited and can include various types of transistors, such as p-channel MOS (pMOS) transistors or Bipolar Junction Transistors (BJTs). At least one of the transistors of the pass device 240 has one terminal (e.g., the source) connected to the voltage source and another terminal (e.g., the drain) connected to the output terminal or the load. The pass device 240 generates $V_{out}$ responsive to an error signal from the error amplifier 238 as applied to the gates of the transistors $M_{sen}$ and $M_{power}$.

As previously described above, in connection with FIG. 1, the voltage regulation circuit 230 can selectively activate the first and second control loops 232, 234 based on a feedback signal from the second control loop 234 and a replica (scaled version of) the output current. The voltage regulation circuit 230 further includes a current comparator circuit 236 used to provide an output responsive to a relative voltage at the output terminal. As previously described, the output of the current comparator circuit 236 is based on a comparison of the replica or scaled version of the output current to a current limit provided by the reference current source $L_{lim}$ The mode switching circuit can selectively activate the control loops 232, 234 by connecting the error amplifier 238 to one of the output of the current comparator circuit 236 (e.g., $V_{ocp}$) and the feedback signal (e.g., $V_{fb}$) from the second control loop 234. As previously described, the error amplifier 238 compares a reference voltage (e.g., $V_{ref}$) to the output of the current comparator circuit 236 (e.g., $V_{ocp}$) or the feedback signal $V_{fb}$ and provides an error signal in response to the comparison. The error signal is connected to the gates of the transistors $M_{sen}$ and $M_{power}$ of the pass device 240 and used to adjust a current passed through the transistors $M_{sen}$ and $M_{power}$ to the output terminal.

In specific embodiments, the mode switching circuit includes a voltage comparator circuit 244 and the switches S1 and S2. The switches S1 and S2 are controlled by an output signal from the voltage comparator circuit 244 and used to selectively connect nodes $V_{ocp}$ or $V_{fb}$ to the error amplifier 238. The voltage comparator circuit 244 can include a (finite/small) non-zero hysteresis used to prevent or mitigate constant switching between the loops or modes and/or allow for the voltage regulation circuit 230 to activate only one control loop at a time. Using the specific example illustrated by FIG. 2, when the second control loop 234 is activated, the voltage regulation circuit 230 is operating in a constant voltage mode in which the voltage is regulated. In such an implementation, $I_{sen}$ is less than $L_{lim}$ and $V_{fb}$ is greater than $V_{ocp}$ which can be represented as:

$$I_{sen}<I_{lim}\rightarrow V_{fb}>V_{ocp} \quad \text{Eq. 1}$$

The voltage comparator circuit 244 compares $V_{fb}$ to $V_{ocp}$ and outputs a high signal (e.g., 1), which can be represented as:

$$I_{sen}<I_{lim}\rightarrow V_{fb}>V_{ocp}\rightarrow CMP=1 \quad \text{Eq. 2}$$

The output signal is used to control the switches S1 and S1. In response to the signal output of 1 from the voltage comparator circuit 244, the switch S2 is closed and the switch S1 is opened, which activates the second control loop 234 and deactivates the first control loop 232 (e.g., causes the first control loop 232 to be or become inactive). The second control loop 234 causes $V_{out}$ to regulate to the desired value. As would be appreciated by one of ordinary skill, if the feedback signal includes a voltage that is lower than the reference voltage $V_{ref}$, the gates of the transistors $M_{sen}$ and $M_{power}$ are pulled lower, which allows for more current to pass and increases the output voltage. If the feedback signal includes a voltage that is higher than the reference voltages $V_{ref}$, the gates of the transistors $M_{sen}$ and $M_{power}$ are pulled higher, which allows for less current to pass and decreases the output voltage.

In the event of an over-current fault condition, the node $V_{ocp}$ rises as $I_{sen}$ is greater than $I_{lim}$ and $V_{fb}$ is less than $V_{ocp}$ which can be represented as:

$$I_{sen}>I_{lim}\rightarrow V_{fb}<V_{ocp} \quad \text{Eq. 3}$$

The voltage comparator circuit 244 compares $V_{fb}$ to $V_{ocp}$ and outputs a low signal (e.g., 0), which can be represented as:

$$V_{ocp} \text{ rises since } I_{sen}>I_{lim}\rightarrow V_{fb}<V_{ocp}\rightarrow CMP=0 \quad \text{Eq. 4}$$

In response to the signal output of 0 from the voltage comparator circuit 244, the switch S1 is opened and the switch S1 is closed, which activates the first control loop 232 and deactivates the second control loop 234 (e.g., causes the second control loop 234 to be inactive). In such an implementation, the voltage regulation circuit 230 is operating in a constant current mode in which the current is regulated. The first control loop 232 causes the output current to regulate to the set limit value. For example, if the output of the current comparator circuit 236 includes a voltage that is higher than the reference voltages $V_{ref}$, the gates of the transistors $M_{sen}$ and $M_{power}$ are pulled higher, which allows for less current equal to a maximum set OCP limit current to pass and decreases the output voltage and current.

Figure 3:
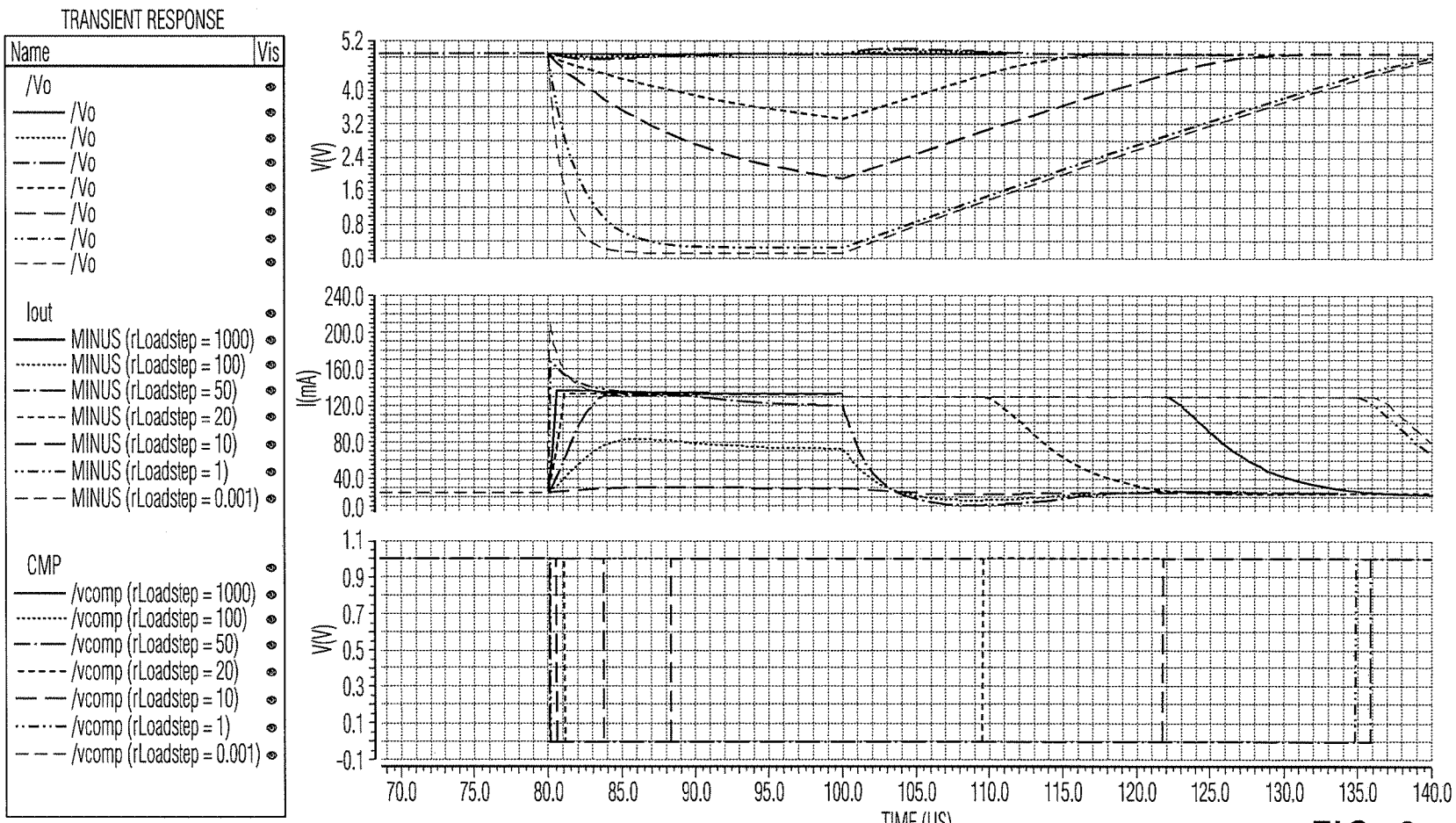
FIG. 3 is a graph illustrating a voltage regulation circuit entering a first mode and transitioning to a second mode and back for different output currents during an over-current fault condition, in accordance with the present disclosure.

FIG. 3 is a graph illustrating a voltage regulation circuit entering a first mode and transitioning back to a second mode and back for different output currents during an over-current fault condition, in accordance with various embodiments. The voltage regulation circuit can enter into operation of the first mode (e.g., a constant current mode) responsive to an OCP fault condition occurring. As illustrated, the first mode is entered and goes back to the second mode (e.g., constant voltage mode) when different values of load resistors are connected and disconnected at $V_{out}$. As further illustrated, the voltage regulation circuit transitions from the second mode to the first mode, responsive to the OCP fault condition, and back in a smooth fashion.

Figure 4:
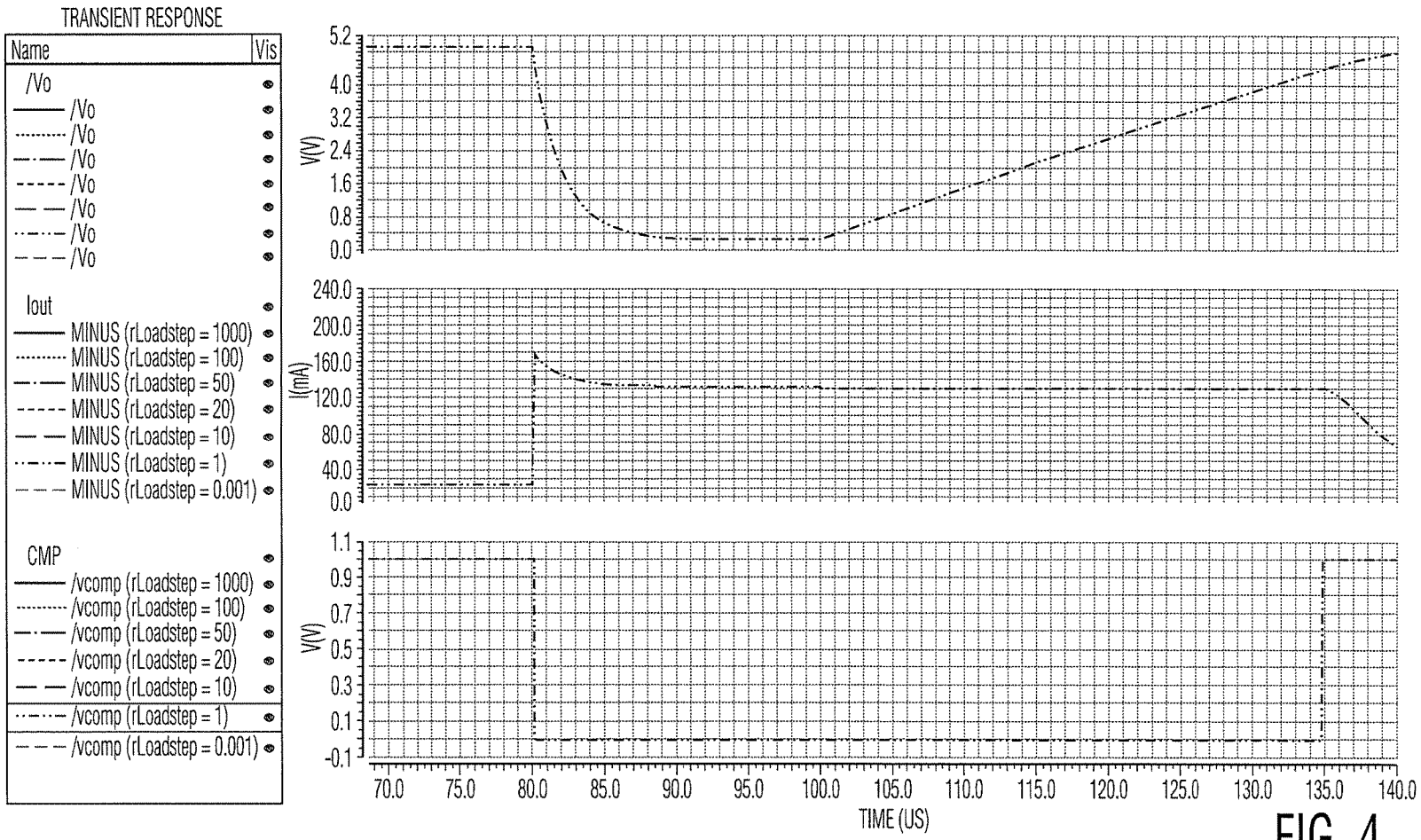
FIG. 4 is a graph illustrating an instance of the transition of a voltage regulation circuit, as illustrated by FIG. 3, in accordance with the present disclosure.

FIG. 4 is a graph illustrating an instance of the transition of the voltage regulation circuit, as illustrated by FIG. 3, in accordance with various embodiments. More specifically, the graph illustrates an implementation of one instance from FIG. 3 in which $R_{load}$ is 1Ω for clarity purposes.

Figure 5:
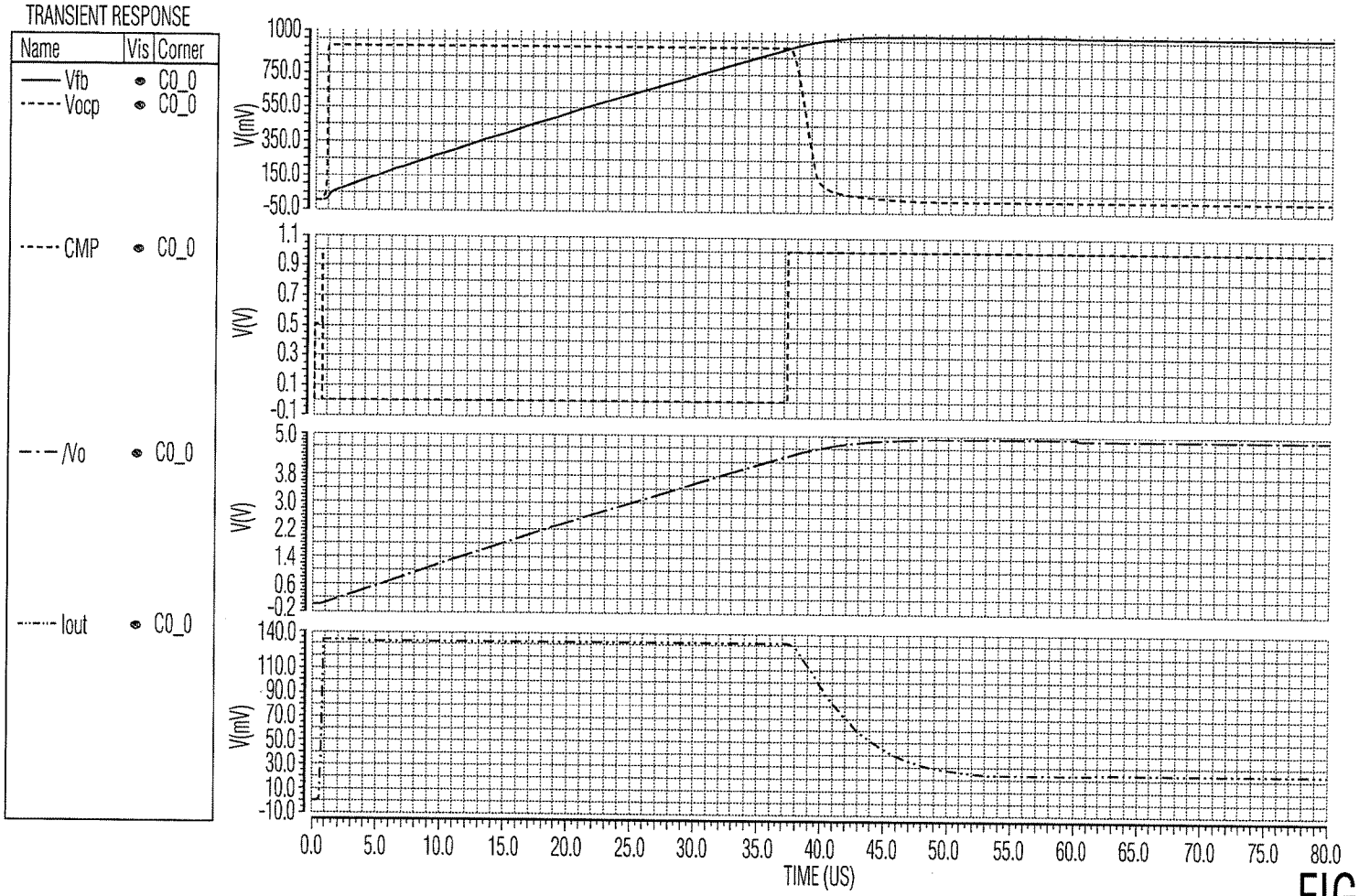
FIG. 5 is a graph illustrating a soft-start operation of a voltage regulation circuit, in accordance with the present disclosure.

FIG. 5 is a graph illustrating a soft-start operation of a voltage regulation circuit, in accordance with various embodiments. As previously discussed, the soft-start operation of the voltage regulation circuit, such as the circuit illustrated by FIG. 1, automatically occurs.

Terms to exemplify orientation, such as upper/lower, left/right, top/bottom and above/below, may be used herein to refer to relative positions of elements as shown in the figures. It should be understood that the terminology is used for notational convenience only and that in actual use the disclosed structures may be oriented different from the orientation shown in the figures. Thus, the terms should not be construed in a limiting manner.

The skilled artisan would recognize that various terminology as used in the Specification (including claims) connote a plain meaning in the art unless otherwise indicated. As examples, the Specification describes and/or illustrates aspects useful for implementing the claimed disclosure by way of various circuits or circuitry which may be illustrated as or using terms such as blocks, modules, device, system, unit, controller, and/or other circuit-type depictions (e.g., reference numerals 104 and 108 of FIG. 1 depict a block/module as described herein). Such circuits or circuitry are used together with other elements to exemplify how certain embodiments may be carried out in the form or structures, steps, functions, operations, activities, etc. For example, in certain of the above-discussed embodiments, one or more modules are discrete logic circuits or programmable logic circuits configured and arranged for implementing these operations/activities, as may be carried out in the approaches shown in FIGS. 1 and 2. In certain embodiments, such a programmable circuit is one or more computer circuits, including memory circuitry for storing and accessing a program to be executed as a set (or sets) of instructions (and/or to be used as configuration data to define how the programmable circuit is to perform), and an algorithm or process as described throughout is used by the programmable circuit to perform the related steps, functions, operations, activities, etc. Depending on the application, the instructions (and/or configuration data) can be configured for implementation in logic circuitry, with the instructions (whether characterized in the form of object code, firmware or software) stored in and accessible from a memory (circuit). As another example, where the Specification may make reference to a "first transistor" a "second transistor," etc., (or "loop" or other structure referencing terms such as "circuit," "circuitry" and others, the adjectives "first" and "second" are not used to connote any description of the structure or to provide any substantive meaning; rather, such adjectives are merely used for English-language antecedence to differentiate one such similarly-named structure from another similarly-named structure.

Based upon the above discussion and illustrations, those skilled in the art will readily recognize that various modifications and changes may be made to the various embodiments without strictly following the exemplary embodiments and applications illustrated and described herein. For example, methods as exemplified in the Figures may involve steps carried out in various orders, with one or more aspects of the embodiments herein retained, or may involve fewer or more steps. For instance, one or more of the components illustrated in FIG. 2 can be part of FIG. 1. Such modifications do not depart from the true spirit and scope of various aspects of the disclosure, including aspects set forth in the claims.

What is claimed is:

1. A voltage regulation circuit comprising:

an error amplifier configured and arranged to provide an error signal based on a comparison of a reference voltage and a voltage;

a pass device including at least one pass transistor configured and arranged to respond to the error signal from the error amplifier by selectively passing current to an output terminal based on the error signal which is connected to an input of the pass device;

a first control loop, including first circuitry including the error amplifier and the pass device, configured and arranged to regulate an output current provided to the output terminal with the pass device responding to the error signal from the error amplifier by selectively passing current to the output terminal based on the error signal;

a second control loop, including second circuitry including the error amplifier and the pass device, configured and arranged to regulate an output voltage provided to the output terminal with the pass device responding to the error signal from the error amplifier by selectively passing current to the output terminal based on the error signal, wherein the first and the second control loops are separately activatable; and a mode switching circuit configured and arranged to switch operation between the first and the second control loops by separately activating one of the first and second control loops and deactivating the other in response to a fault condition at the output terminal at which a regulated load is connectable.

2. The voltage regulation circuit of claim 1, further including:

a current comparator circuit configured and arranged to provide an output responsive to a relative voltage indicative of a current at the output terminal; and wherein the mode switching circuit is further configured and arranged to switch the operation between the first and the second control loops in response to the output provided by the current comparator circuit and the second control loop.

3. The voltage regulation circuit of claim 1, wherein the mode switching circuit is configured and arranged to switch between the first and the second control loops with a finite non-zero hysteresis, such that only one of the first and the second control loops is active at the same time.

4. The voltage regulation circuit of claim 1, the voltage regulation circuit is configured and arranged to operate in a first mode responsive to the fault condition being an over current fault condition, and during the first mode, the first control loop is configured and arranged to be active and the second control loop is configured and arranged to be inactive.

5. The voltage regulation circuit of claim 1, further including:

a first feedback circuit configured and arranged to provide the first control loop; and a second feedback circuit configured and arranged to provide the second control loop.

6. The voltage regulation circuit of claim 1, further including a current comparator circuit configured and arranged to provide an input to the mode switching circuit, the input being indicative of an over current fault condition or indicative of no over current fault condition, and wherein the input causes the mode switching circuit to switch between the first and second control loops.

7. The voltage regulation circuit of claim 6, wherein:

the error amplifier is configured and arranged to provide the error signal based on a comparison of the reference voltage and a voltage that is a function of the output voltage at the output terminal, the voltage including the output provided by the current comparator circuit or a feedback signal from the second control loop; and the pass device including at least one pass transistor configured and arranged to respond to the error signal from the error amplifier by selectively passing current to the output terminal based on the error signal which is connected to inputs of transistors of the pass device.

8. A voltage regulation circuit comprising:

a first feedback circuit configured and arranged to provide a first control loop;

a second feedback circuit configured and arranged to provide a second control loop, the first and second control loops being separately activatable;

a comparator circuit configured and arranged to provide an output responsive to a relative voltage indicative of a current at an output terminal at which a regulated load is connectable; and a mode switching circuit configured and arranged to switch operation between the first and second control loops by separate activation in response to a fault condition at the output terminal and the output provided by the comparator circuit;

common control circuitry configured and arranged as part of both the first and second control loops, wherein the common control circuitry includes:

an error amplifier configured and arranged to provide an error signal based on a comparison of a reference voltage and a first voltage; and a pass device including at least one pass transistor configured and arranged to respond to the error signal from the error amplifier when part of the first control loop and when part of the second control loop by adjusting a current provided to the output terminal and reducing the error signal.

9. The voltage regulation circuit of claim 8, wherein the relative voltage at the output terminal is indicative of a scaled version of the current at the output terminal, and the comparator circuit is further configured and arranged to provide the output to the mode switching circuit, the output being indicative of the fault condition or indicative of no fault condition, and wherein the output causes the mode switching circuit to switch between the first and second control loops.

10. The voltage regulation circuit of claim 8, wherein the first feedback circuit is configured and arranged to regulate a current at the output terminal via the first control loop and the second feedback circuit is configured and arranged to regulate a voltage at the output terminal via the second control loop.

11. The voltage regulation circuit of claim 8, wherein the mode switching circuit is configured and arranged to switch between the first and the second control loops such that only one of the first and the second control loops is active at the same time.

12. A voltage regulation circuit comprising:

a first feedback circuit configured and arranged to provide a first control loop;

a second feedback circuit configured and arranged to provide a second control loop, the first and second control loops being separately activatable;

a comparator circuit configured and arranged to provide an output responsive to a relative voltage indicative of a current at an output terminal at which a regulated load is connectable; and a mode switching circuit configured and arranged to switch operation between the first and second control loops by separate activation in response to a fault condition at the output terminal and the output provided by the comparator circuit;

wherein the mode switching circuit includes:

at least one switch circuit; and a second comparator circuit configured and arranged to provide an output signal to the at least one switch circuit based on a comparison of a voltage at the output terminal and the provided output of the comparator circuit, the provided output of the comparator circuit being based on a comparison of the relative voltage and a current limit, and the at least one switch circuit being configured and arranged to respond to the output signal provided by the second comparator circuit by selectively activating one of the first and second control loops at a time.

13. The voltage regulation circuit of claim 12, further including common control circuitry configured and arranged as part of both the first and second control loops, wherein the common control circuitry includes:

an error amplifier configured and arranged to provide an error signal based on a comparison of a reference voltage and a voltage that is a function of an output voltage at the output terminal, the voltage including the output provided by the comparator circuit or a feedback signal from the second control loop; and a pass device including at least one pass transistor configured and arranged to respond to the error signal from the error amplifier by adjusting a current provided to the output terminal and reducing the error signal.

14. The voltage regulation circuit of claim 8, wherein:

the voltage regulation circuit is configured and arranged to operate in a first mode responsive to the fault condition, and during the first mode, the first control loop is configured and arranged to be active and dominant over the second control loop.

15. The voltage regulation circuit of claim 14, wherein the second control loop is configured and arranged to be inactive during the first mode.

16. The voltage regulation circuit of claim 8, wherein the mode switching circuit is configured and arranged to activate the first control loop in response to a startup of the voltage regulation circuit and to activate the second control loop in response to the voltage at the output terminal reaching a set-point.

17. The voltage regulation circuit of claim 1, further including:

a current comparator circuit configured and arranged to provide an output responsive to a relative voltage indicative of a current at the output terminal;

wherein in the first control loop, the error amplifier is configured and arranged to provide the error signal based on a comparison of the reference voltage and a voltage provided by the output provided by the current comparator circuit.

18. The voltage regulation circuit of claim 17 wherein in the second control loop, the error amplifier is configured and arranged to provide the error signal based on a comparison of the reference voltage and a voltage provided by a feedback signal from the second control loop.

19. The voltage regulation circuit of claim 1, further comprising:

a comparator circuit configured and arranged to provide an output responsive to a relative voltage indicative of a current at the output terminal;

wherein the mode switching circuit includes:

at least one switch circuit; and a second comparator circuit configured and arranged to provide an output signal to the at least one switch circuit based on a comparison of a voltage at the output terminal and the provided output of the comparator circuit, the provided output of the comparator circuit being based on a comparison of the relative voltage and a current limit, and the at least one switch circuit being configured and arranged to respond to the output signal provided by the second comparator circuit by selectively activating one of the first and second control loops at a time.

20. The voltage regulation circuit of claim 8 wherein the first voltage is of the output provided by the comparator circuit when the error amplifier is part of the first control loop and the first voltage is of a feedback signal from the second control loop when the error amplifier is part of the second control loop.

* * * * *